United States Patent [19]

Ivester et al.

[11] Patent Number: 4,869,736

[45] Date of Patent: Sep. 26, 1989

[54] COLLECTING ELECTRODE PANEL ASSEMBLY WITH COUPLING MEANS

[75] Inventors: Frank D. Ivester, Alabaster; Kenneth P. Sransky, Trussville; James C. Bonds, Hayden, all of Ala.

[73] Assignee: Combustion Engineering, Inc., Windsor, Conn.

[21] Appl. No.: 305,047

[22] Filed: Feb. 2, 1989

[51] Int. Cl.[4] ..... B03C 3/02

[52] U.S. Cl. ..... 55/156; 24/336

[58] Field of Search ..... 55/140, 148, 154, 156; 24/336, 335

[56] References Cited

U.S. PATENT DOCUMENTS

| | | | |
|---|---|---|---|
| 3,312,444 | 4/1967 | De Sena | 24/336 |
| 3,402,526 | 9/1968 | Baxter | 55/156 |
| 4,240,810 | 12/1980 | Frauenfelder | 55/148 |
| 4,640,695 | 3/1987 | Adams et al. | 55/148 |
| 4,759,779 | 7/1988 | Shedd | 55/156 |

*Primary Examiner*—Bernard Nozick

*Attorney, Agent, or Firm*—William W. Habelt

[57] ABSTRACT

A collecting electrode panel assembly (20) comprises a plurality of collecting electrode plates (22) disposed in successively aligned relationship beneath and suspended from an electrode support member (14) supported by the housing (12) of an electrostatic precipitator (10), such that the collecting electrode plates (22) making up the collecting electrode panel assembly (20) extend downwardly in a substantially vertical plane into the precipitation chamber (6) defined within the housing (12). Each of the plates (22) has a pair of spaced end members (24) and a central web portion (26) which extends between and interconnects the spaced end members (24). Coupling means (50) are disposed between the facing opposed end members (24) of successive plates (22) at least one location along the vertical interface of successive plates (22) to restrain bowing or warping of the assembled collecting electrode panel (20) and to keep the collecting electrode plates (22) in a common plane.

1 Claim, 3 Drawing Sheets

COLLECTING ELECTRODE PANEL ASSEMBLY WITH COUPLING MEANS

BACKGROUND OF THE INVENTION

The present invention relates to electrostatic precipitators and, more particularly, to segmented collecting electrode panels, each panel comprised of a plurality of aligned collecting electrode plates suspended from a support beam and linked together by coupling means.

In the operation of an electrostatic precipitator, a gas laden with entrained particulate material will pass through an electrostatic field established about a discharge electrode assembly disposed intermediate to grounded collecting electrode panels. The suspended particles become electrically charged as they pass through the electrostatic field and move to, under the influence of the electrostatic field, and deposit upon the ground collecting electrode panels flanking the discharge electrode assembly.

Although the prior art includes various collecting electrode panel designs, collecting electrode panels are commonly constructed in modular form by suspending a plurality of successively aligned collecting electrode plates in end to end relationship to form the collecting electrode panel. Each collecting electrode plate is typically suspended from a support beam mounted in the top of the precipitator housing to extend downwardly in a vertical plane. Each individual plate is formed of sheet metal and typically ranges from 1 to 3 feet in width and typically from 30 to 50 feet in length. Typically, each panel includes an elongated central web portion, which may be a flat plate or a plate-like member with stiffening protrusions, and spaced end portions which generally comprise J-shaped stiffening members, such as shown in U.S. Pat. No. 3,158,453 and U.S. Ser. No. 584,449.

In the case of particularly large panels, such as necessary for the electrostatic precipitators employed to remove particulate matter from the flue gases of electric utility furnaces, it is desirable to link neighboring collecting electrode plates together to provide a certain amount of rigidity to the overall collecting electrode panel and provide resistance to bowing and warping of the panel. Accordingly, it is general practice to provide some means of linking the adjacent ends of neighboring plates together. One method for linking the collecting electrode plates is to design the end portions of the collecting electrode plates to directly interlock one with the other such as disclosed in U.S. Pat. Nos. 3,402,526; 3,418,792; and 3,616,605.

In order to avoid the restriction of relative movement that results when the collecting electrode plates are directly interlocked and permit limited longitudinal movement of the plates of a panel during rapping, it is known to link the adjacent ends of neighboring collecting electrode plates together by means of a spring clip as disclosed in U.S. Pat. No. 4,239,514. Such a spring clip comprises an elongated spring strip which is mounted at its opposite ends to the opposed ends of the neighboring collecting electrode plates thereby linking the neighboring collecting electrode plates.

Alternatively, a somewhat less rigid collecting electrode panel may be constructed as shown in U.S. Pat. No. 4,240,810 wherein a guide bracket is mounted to the end of one collecting electrode plate so as to extend therefrom to flank the end of its neighbor. As the bracket flanks, but is not mounted to the second plate, resistance to bowing and warping is provided while permitting movement between neighboring plates.

SUMMARY OF THE INVENTION

The collecting electrode panel assembly of the present invention comprises a plurality of collecting electrode plates disposed in successively aligned relationship and linked together end to end by coupling means so as to restrain bowing and warping of assembled plates and provide a measure of rigidity to the assembled plates to facilitate the distribution of rapping forces during cleaning.

The collecting electrode panel assembly of assembled collecting electrode plates is adapted to be suspended within the housing of an electrostatic precipitator, such that the collecting electrode plates making up the collecting electrode panel extend downwardly in a substantially vertical plane into the precipitation chamber defined within the housing. Each of the collecting electrode plates has a pair of spaced end members and a central web portion which extends between and interconnects the spaced end members. Each end member of the collecting electrode plates has an end portion extending substantially transverse to the central web portion thereof such that the respective end portions of adjacent collecting electrode plates face each in opposed spaced relationship at the interface between the adjacent collecting electrode plates when disposed in successively aligned relationship to form the collecting electrode panel.

To link the adjacent collecting electrode plates together in accordance with the present invention, coupling means are disposed at the interface of each pair of successively aligned collecting electrode plates. Each coupling means has a base member which is mounted to the end portion of one end member of one of the successively aligned plates and a pair of laterally spaced side members which extend outwardly from the base member to flank the opposing end member of the other of the successively aligned collecting electrode plates. Engagement means are provided in association with each of the side members for engaging the flanked end member in locking relationship.

BRIEF DESCRIPTION OF THE DRAWING

The present invention will be better understood and the above and other objects of the present invention will become more apparent and appreciated when viewed in light of the following description of a preferred embodiment with reference to the accompanying drawings, wherein.

DESCRIPTION OF THE PREFERRED EMBODIMENTS

Figure 1:
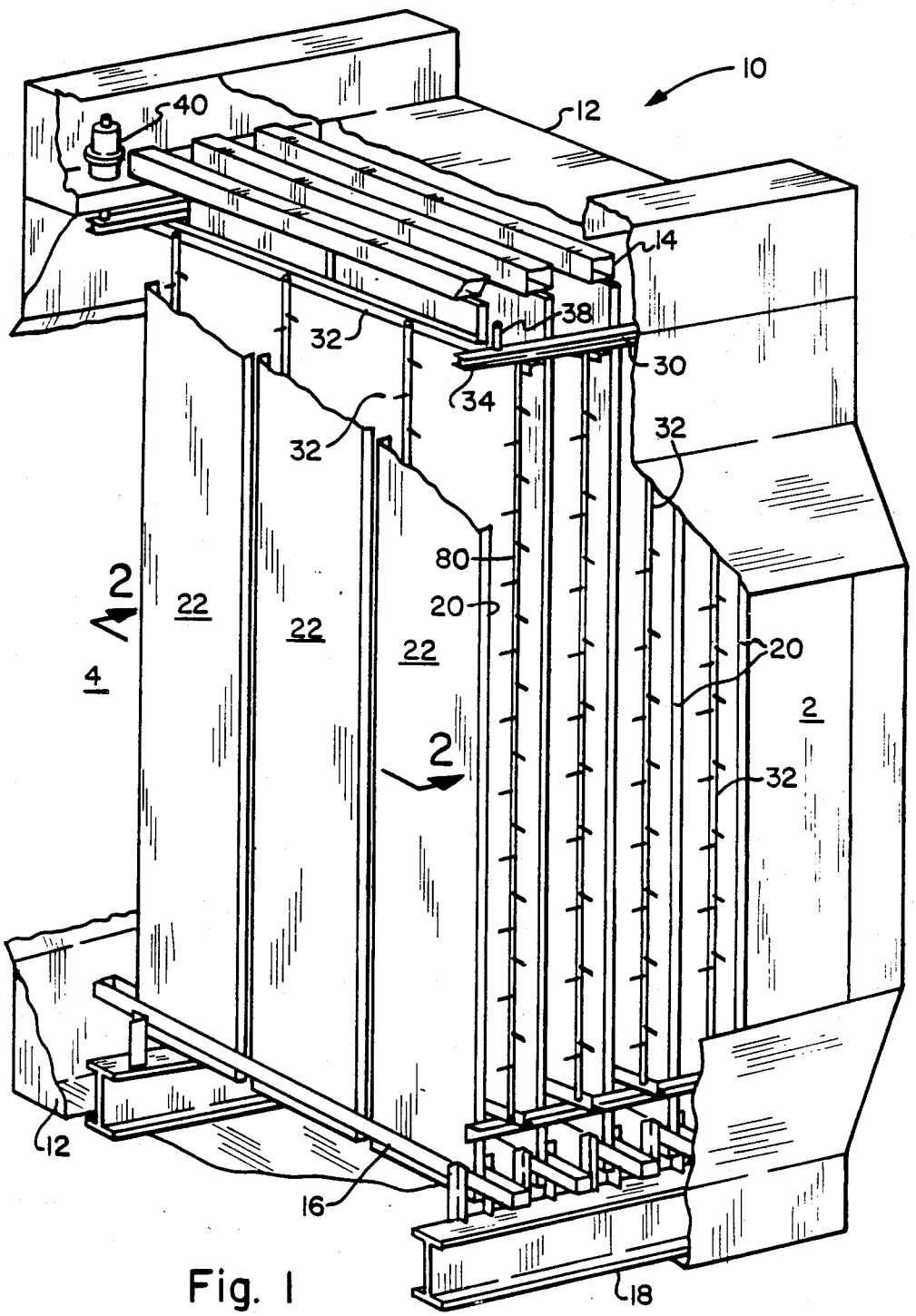
FIG. 1 is a perspective view, partly in section, of an electrostatic precipitator.
Figure 2:
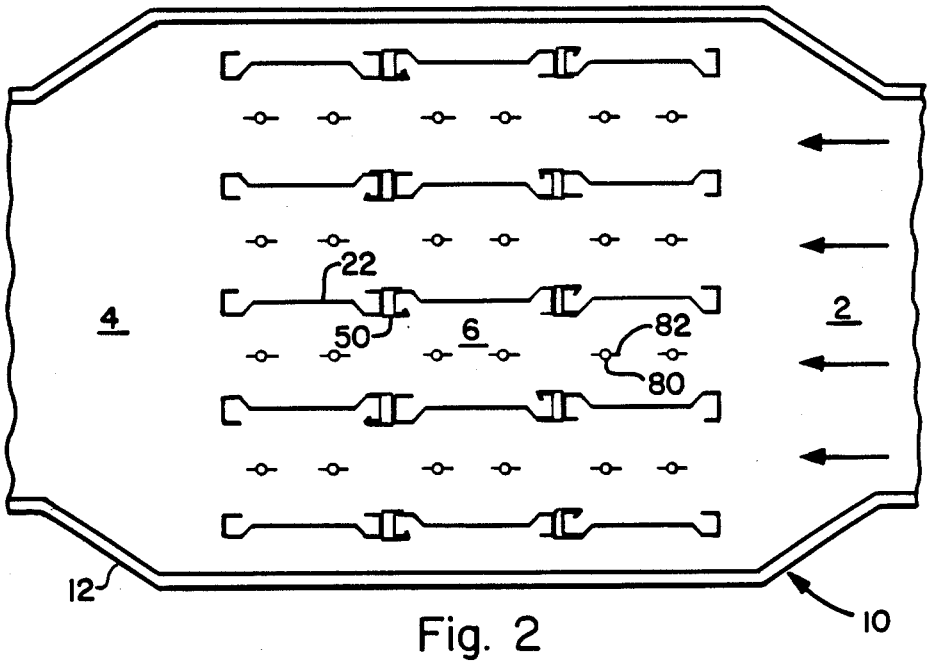
FIG. 2 is a sectional plan view taken along line 2—2 of FIG. 1 illustrating the spacers of the present invention in the electrostatic precipitator of FIG. 1.

Referring now to the drawing, and most particularly, to FIGS. 1 and 2 thereof, there is depicted therein an electrostatic precipitator 10 having a casing 12 with an inlet 2 and outlet 4 and precipitation chamber 6 disposed therebetween. The particulate laden flue gas to be cleaned passes through the housing 12 of the precipitator 10 passing from the gas inlet 2 through the precipitation chamber 6 and out the gas outlet 4 as clean, relatively particulate free gas.

A plurality of collecting electrode panels 20 are disposed in substantially parallel, spaced relationship in vertical planes within the precipitation chamber 6. Interdisposed in the spaces between the collecting electrode panels 20 are a plurality of discharge electrode subassemblies 32, which collectively form a discharge electrode assembly 30. Both the collecting panels 20 ad the discharge electrode subassemblies 32 are aligned parallel to and extend in the direction of gas flow through the precipitation chamber 6 from the inlet 2 to the outlet 4 thereof.

Each of the individual discharge electrode subassemblies 32 is formed of a plurality of individual tubular discharge electrodes 80 disposed at spaced intervals to extend transversely between and be mounted to an upper frame member and a lower frame member of the subassemblies. The individual discharge electrode subassemblies are suspended from a support bar 34, which extends across the top of the precipitation chamber 6 and is mounted to the casing 12 through insulators 40. The individual discharge electrodes 80 are shown as tubular discharge electrodes having a plurality of corona discharge pins 82 extending outwardly from the tubular portion of the discharge electrode.

The discharge electrodes are shown in the drawing as being of this particular design, merely for purposes of illustration and not limitation. It is to be understood that the present invention contemplates utilizing any of a number of discharge electrode designs known in the art. For example, the discharge electrodes 80 could consist of a plurality of wires or rods, with or without corona discharge points disposed along their length. If the discharge electrodes are of tubular design, the tubular members could have a circular or elliptical cross-section or any other appropriate cross-section which would yield the desired electrostatic field configuration.

In operation, a particulate laden gas enters the precipitator casing 12 through the inlet 2 thereof and flows through the precipitation chamber 6 to the outlet 4 thereof. In traversing the precipitation chamber 6, the particulate laden gas flows between the spaced collecting electrode panels 20 and over the discharge electrode subassemblies 32 suspended therebetween. An electrical charge is applied to each of the discharge electrode subassemblies 32, so as to establish an electrostatic field extending between the discharge electrodes 80 and the grounded collecting electrode panels 20. As the particulates within the gas pass through the precipitation chamber 6, the particles are ionized and migrate to and deposit upon the collecting electrode plates 22 forming the grounded collecting electrode panel 20.

Figure 4:
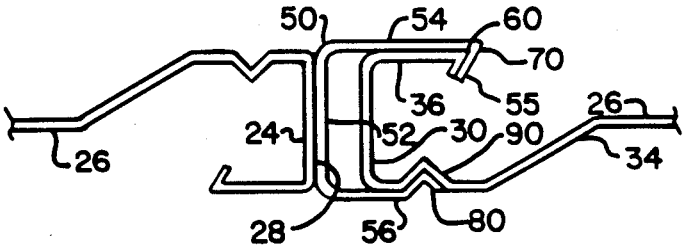
FIG. 4 is a cross-sectional plan view of the coupling means of the present invention taken along line 4—4 of FIG. 3.
Figure 6:
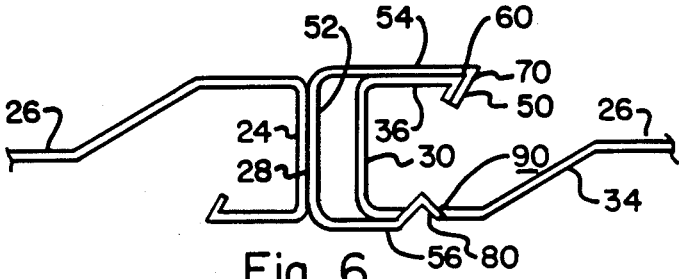
FIG. 6 is a cross-sectional plan view of the coupling means of the present invention taken along line 6—6 of FIG. 5.
Figure 3:
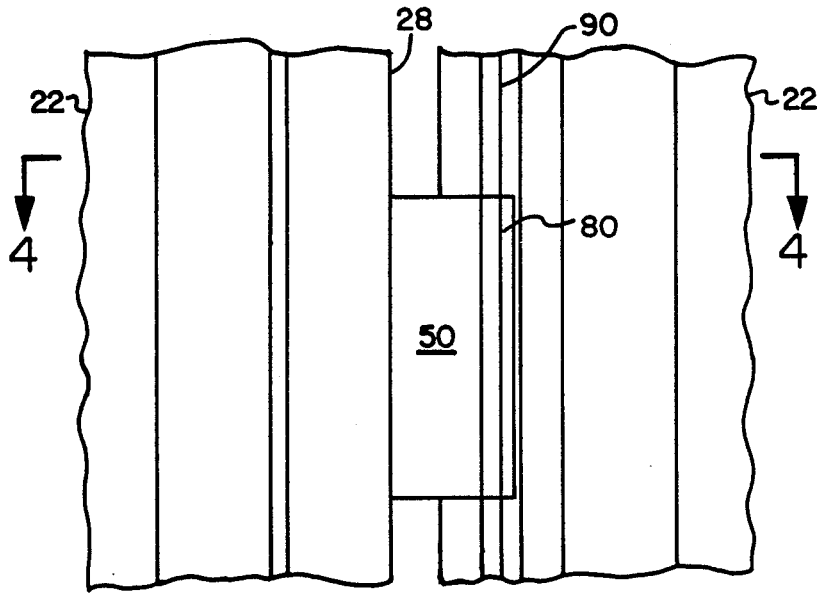
FIG. 3 is an enlarged detailed side elevational view illustrating the coupling means installed in one manner between the collecting electrode plates of two neighboring collectrode electrode panels in accordance with the present invention.
Figure 5:
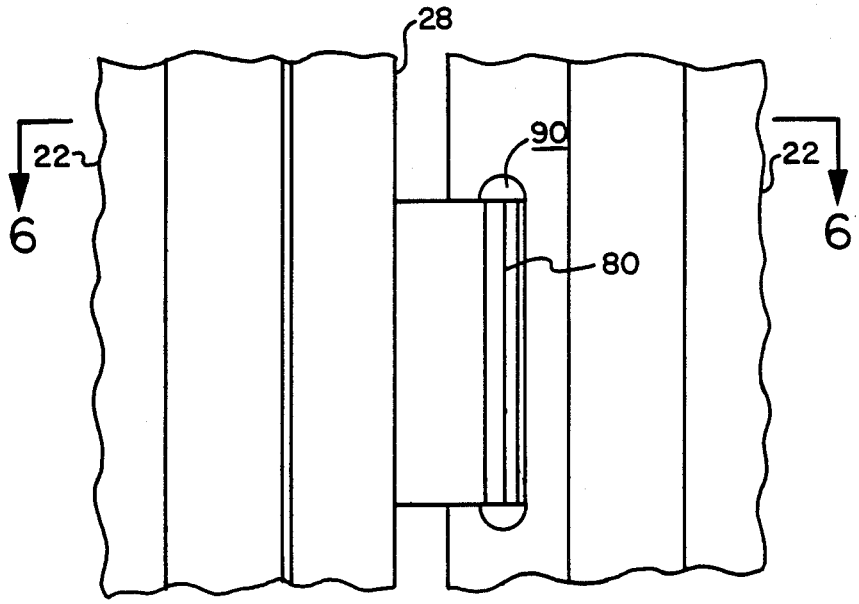
FIG. 5 is an enlarged detailed side elevational view illustrating the coupling means installed in another manner between the collecting electrode plates of two neighboring collectrode electrode panels in accordance with the present invention.

As depicted in FIGS. 3 and 5, each collecting electrode panel 20 is formed of a plurality for collecting electrode plates 22, which are coupled together in successively aligned relationship. Each collecting electrode panel 20 is suspended from an electrode support member or beam 14, which extends across the top of the precipitation chamber 6 and is adapted to be supported by the housing 12 of the precipitator 10. Each of the collecting electrode plates 22 is comprised of a pair of spaced end members 24 and a central web portion 26, extending between and interconnecting the spaced end members 24. Each end member 24 has a base surface 28 presenting a surface extending substantially transverse into the central web portion 26 of the collecting electrode plate. As best seen in FIGS. 4 and 6, each end member 24 of each of the collecting electrode plates 22 comprises an elongated beam of hook-shaped cross-section having a base portion 30 having a transverse base surface 28, a stem portion 34 extending rearwardly from one side of the base portion 30 to connect to the central web portion 26 of the collecting electrode plate, and a fore-shortened leg portion 36 extending rearwardly from the other side of the base portion 30.

To restrain bowing and/or warping of the assembled collecting electrode panel 20 and to keep the individual collecting electrode plates 22 forming the collecting electrode panel 20 in successive alignment in a common plane, coupling means 50 are disposed between the facing opposed ends of successive plates 22 at least one location along the vertical interface of successive plates. Each coupling means 50 comprises a generally U-shaped, rigid member having a base portion 52 and a pair of laterally spaced legs 54 and 56 extending substantially perpendicularly outward from the base portion 52. The base portion 52 of each coupling means 50 is rigidly secured, such as by welding or bolting, to the edge surface 28 of the base portion 30 of the end member 24 of one collecting electrode plate 22 with the spaced legs 54 and 56 thereof extending longitudinally outwardly to flank the end member 24 of the next successively aligned collecting electrode plate 22 of the panel 20 in the cavity formed between the outwardly extending spaced legs 54 and 56 so as to restrain lateral movement of the neighboring plate. Engagement means 70 and 80 are respectively operatively associated with the first leg 54 and the second leg 56 of the spaced legs extending longitudinally outwardly from the base portion 52 of the coupling means 50 and flanking the opposed end member 24 of the next successively aligned collecting electrode plate 22. Engagement means 70 and 80 are each adapted to engage in locking relationship the opposed end member 24 flanked by the spaced legs 54 and 56 of the coupling means 50.

Preferably, the stem portion 34 of one end member 24 of each of the collecting electrode plates 22 has formed integrally therein an engagement channel 90 adapted to receive the engagement means associated with the leg of the coupling means 50 flanking the end member thereby securing the flanked end member in locking relationship with the coupling means. The engagement channel 90 may comprise an inwardly protruding groove formed in the stem portion 34 as illustrated in FIG. 4, or a slot cut through the stem portion 34 as illustrated in FIG. 6, or any other form which permits a locking relationship to be formed when the engagement channel 90 receives the engagement means.

Most advantageously, the engagement means 70 operatively associated with the first leg 54 of the coupling means 50 comprises an engagement hook formed by an inwardly directed tip 55 which extends reversely from the outer end of the first leg 54 to form an opening 60 adapted to receive the fore-shortened leg portion 36 which extends rearwardly from the base portion 30 of the flanked end member 24. The other engagement means 80 operatively associated with the second leg 56 of the coupling means 50, however, preferably comprises a clip formed by inwardly crimping the second leg 56 of the coupling means 50. The clip 80 is adapted to insert into the engagement channel 90 when the end member 24 is engaged within the coupling means 50. With the engagement hook 70 of the first leg 54 of the coupling means grasping the foreshortened leg portion 36 of the engaged end member 24, the clip 80 of the second leg 56 received in the engagement channel 90 of the stem portion of the engaged end member 24, and the base portion 52 of the coupling means 50 secured to the base portion 30 of the opposed end member 24, the two successive collecting electrode plates 22 are linked together in secured locking relationship as illustrated in the drawing to form collecting electrode panel 20 restraint to bowing and wrapping, and exhibiting enhanced response to rapping during cleaning.

Although described and illustrated herein with reference to the preferred embodiment shown in the drawings which represents the best mode presently contemplated for carrying out the present invention, it is to be understood that many variations of the depicted embodiment may be envisioned by those skilled in the art without departing from the basic concept of the present invention. Accordingly, it is intended that the present invention be interrupted in spirit and in scope as defined by the claims appended hereto.

We claim:

1. A collecting electrode panel assembly for mounting within a precipitation chamber housing of an electrostatic precipitator, comprising:

a. at least a pair of collecting electrode plates adapted to be suspended within the precipitation chamber in successively aligned relationship, each of said collecting electrode plates having a pair of spaced end members and a central web portion extending between and interconnecting the spaced end members, each of the end members comprising an elongated beam of substantially hooked-shaped cross-section having a base portion extending substantially transversely to the central web portion, a stem portion extending rearwardly from one side of the base portion and connected to the central web portion and a foreshortened leg portion extending rearwardly from the other side of the base portion, the stem portion having an engagement channel formed therein;

b. coupling means disposed at the interface of each pair of successively aligned collecting electrode plates, said coupling means comprising a substantially channel shaped member having a base member mounted to the base portion of the end member of one of the pair of successively aligned collecting electrode plates and first and second laterally spaced side members, the first of said side members extending outwardly from one side of the base member along the leg portion of the opposing end member of the other of the pair of successively aligned collecting electrode plates and the second of said side members extending outwardly from the opposite side of the base member along the stem portion of the opposing end member of the other of the pair of successively aligned collecting electrode plates;

c. hook means disposed at the end of the first of said side members for grasping in locking relationship the fore-shortened leg portion of the opposing end member of the other of the pair of successively aligned collecting electrode plates; and d. clip means disposed at the end of the second of said side members for interlocking into the engagement slot of the stem portion of the opposing end member of the other of the pair of successively aligned collecting electrode plates.

* * * * *